US010520283B2

(12) United States Patent
Behnk, Jr.

(10) Patent No.: US 10,520,283 B2
(45) Date of Patent: Dec. 31, 2019

(54) RANGE TARGET FOR RIFLE, PISTOL AND SHOTGUN APPLICATIONS

(71) Applicant: Ronald C. Behnk, Jr., Belchertown, MA (US)

(72) Inventor: Ronald C. Behnk, Jr., Belchertown, MA (US)

( * ) Notice: Subject to any disclaimer, the term of this patent is extended or adjusted under 35 U.S.C. 154(b) by 46 days.

(21) Appl. No.: 16/002,931

(22) Filed: Jun. 7, 2018

(65) Prior Publication Data

US 2019/0011228 A1 Jan. 10, 2019

Related U.S. Application Data

(60) Provisional application No. 62/521,255, filed on Jun. 16, 2017.

(51) Int. Cl.
*F41J 1/00* (2006.01)
*F41J 1/10* (2006.01)

(52) U.S. Cl.
CPC ... *F41J 1/10* (2013.01); *F41J 1/00* (2013.01)

(58) Field of Classification Search
CPC ..... F41J 1/00; F41J 1/10
USPC ..... 273/379–408
See application file for complete search history.

(56) References Cited

U.S. PATENT DOCUMENTS 1,837,627 A * 12/1931 Mead ..... F41J 3/0004 273/403
3,512,778 A * 5/1970 Allen ..... F41J 3/0004 273/403
3,900,778 A * 8/1975 Bruner ..... F41J 3/0004 273/403
5,211,404 A * 5/1993 Grant ..... F41J 1/01 273/407
5,438,972 A * 8/1995 Harbin ..... F41B 7/00 124/16
6,595,878 B1 * 7/2003 Nelson ..... A63B 69/002 273/407
9,255,773 B1 * 2/2016 Hall ..... F41J 7/00
2008/0061509 A1 * 3/2008 Potterfield ..... F41J 1/01 273/403
2009/0058008 A1 * 3/2009 Baumgartner ..... B29C 51/10 273/408
2013/0249168 A1 * 9/2013 Kepple ..... F41H 5/04 273/408

(Continued)

*Primary Examiner* — Mark S Graham
(74) *Attorney, Agent, or Firm* — Hamilton, Brook, Smith & Reynolds, P.C.

(57) ABSTRACT

Honeycomb reusable rifle, pistol and shotgun target consists of a composite of three distinct materials for shooter convenience.

A structural honeycomb kraft cardboard target provides a strong base support with a permanent stick adhesive backer for ease of target field use.

Four sided die cut honeycomb perimeter boundary provides ample fastening surface for pin, staple or spring clip attachment to backer surface.

A 12"×12" center raised honeycomb pad surface provides a smooth, flat but rigid surface for the vinyl preprinted target.

Vinyl target surface is renewed with a peel & stick application of up five fresh vinyl targets for multiple range visits.

Honeycomb target pad is the first reusable range target for use in all weather and temperature conditions.

Honeycomb target pads holds up to hundreds of rounds of bullet impact offering exceptional durability and value for long term use.

11 Claims, 8 Drawing Sheets

Side view of die cut 1" perimeter Honeycomb pad for ease of fastening with Staples, pins, or spring clips

(56) References Cited

U.S. PATENT DOCUMENTS

| | | | | |
|---|---|---|---|---|
| 2014/0091527 | A1* | 4/2014 | Schneider | F41J 1/10 273/407 |
| 2016/0298942 | A1* | 10/2016 | Skinner | F41J 1/10 |
| 2016/0327377 | A1* | 11/2016 | Flynn | F41J 5/205 |
| 2017/0284774 | A1* | 10/2017 | Burks | F41J 1/10 |

* cited by examiner

BULLSEYE 10" DIA
RANGE TARGET

Adhesive back side with (2) strips exposed ready for attachment

Virgin back with 10" adhesive strips 107 rounds of impact from 12 ga 00 buck, 5.56 mm rifle Range test at 25 yds.

Adhesive strips exposed after 25 yd. Range test

Side view of die cut 1" perimeter Honeycomb pad for ease of fastening with Staples, pins, or spring clips

RANGE TARGET FOR RIFLE, PISTOL AND SHOTGUN APPLICATIONS

RELATED APPLICATIONS

This application claims the benefit of U.S. Provisional Application No. 62/521,255, filed on Jun. 16, 2017. The entire teachings of the above application(s) are incorporated herein by reference.

BACKGROUND

Permanent and portable projectile target structures are commercially available to help improve shooting precision and accuracy. Projectile target structures often include bullseye designs. Bullseye projectile targets can be desirable because they can be used to determine the point of impact of the bullet and accuracy of the aim of the shooter. Printable projectile targets exist that incorporate the bullesye design. Some pre-printed range target variations include vinyl paper pre-printed targets, peel & stick adhesive back targets, chemically treated impact evident "splatter" vinyl targets, vinyl paper adhesive backed pre-printed targets, corrugated plastic pre-printed reusable targets, and corrugated cardboard pre-printed re-useable targets.

SUMMARY

While printable projectile targets exist, typically, they are neither durable nor reusable. Upon impact with bullets, projectile targets can become deformed, or in most cases, decimated. Because precision shooting usually requires continuous practice to improve accuracy, a shooter can easily destroy hundreds to thousands of shooting targets while practicing. While paper targets exist with bullseye designs that aid in precision shooting that are cost effective, they are typically not reusable and cannot sustain long term use, even if attached to a backboard. It can be important for any reusable projectile target to maintain the bullseye design so that the point of projectile impact on the bullseye design can be deciphered. As a result, single use, disposable, or throw away targets are typically the norm, but when volume is considered, there is a cost benefit analysis.

Heavy-duty shooting targets, such as those made of steel, are available. Such steel projectile targets could be suitable for long term use; however, they often are expensive, cumbersome to maneuver, and are not environmentally friendly, in that they are not recyclable. Such heavy-duty targets can be difficult to attach to other structures or objects. Further, it is difficult to incorporate a long lasting bullseye design on such heavy duty targets.

It is desirable to have a projectile target that is reusable, recyclable, and inexpensive to manufacture. It is further desirable to have a projectile target that is capable of maintaining the bullseye design, even after continuous projectile impact.

In some inventive embodiments of the invention, a honeycomb target pad is provided that is capable of overcoming the issues discussed above associated with other range targets. According to some embodiments a 14×14 thick structural honeycomb cardboard reusable target pad is provided. A 1 inch perimeter die cut pad border may be provided for ease of direct attachment of the pad to surfaces that can include horizontal and vertical surfaces. The honeycomb target pad preferably is manufactured with water resistant materials of construction. The honeycomb target pad preferably is configured with reusable adhesive with release paper covering for attachment.

In some embodiments, the honeycomb target pad is arranged to have the ability to fasten using four different methods to accommodate a wide variety of range target setups. Fastening options can further include push pins, staples or clips for fastening pads directly to a wide variety of target panel backer surfaces.

In some embodiments, the honeycomb target pad enables reuse of its bullseye target and pad for multiple range visits. Preferably, the honeycomb target pad is configured for ease of use with peel and stick adhesive backed vinyl and cardboard surface.

In some embodiments, the honeycomb target pad enables easy storage and transportation in a bag or original shipping box specifically designed for reuse and storage.

In some embodiments, the honeycomb target pad is designed with 100% recyclable materials in construction for final disposition and proper environmentally friendly disposal.

The present invention can also provide a target device including a target pad formed of honeycomb cellulosic material having a central portion and a perimeter portion. The central portion can have a thickness ranging from about ⅜ to 1 inch that is greater than a thickness of the perimeter portion. The perimeter portion can form an outer perimeter border flange of the target device with reduced thickness for allowing easy securement to a mounting structure with fasteners. The target pad can include a honeycomb cell structure having cells with cell walls surrounding cell cavities. The honeycomb cell structure can be covered on each opposite side with parallel flat sheet material, enclosing or covering the cells. The cell walls can be formed of shaped cellulosic sheet material extending generally perpendicular to the flat sheet material and in a direction parallel to projectile path. The cell cavities can have a size ranging from about ⅜ to 1 inch across to allow the passage of projectiles therethrough with minimal damage to the cell walls. A first target image can extend over the central portion of the target pad.

In particular embodiments, the honeycomb cells can be generally hexagonal in shape. The perimeter portion can be in a compressed state with collapse cell walls to form the outer perimeter border flange with reduced thickness. The perimeter portion can be a step down outer perimeter border flange that allows easy fastening to the mounting structure with staples, pins or spring clips. An adhesive backed second target image can be applied to the central region over the first target image after initial target use, thereby structurally reinforcing the honeycomb cell structure and providing a new second target image for use.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Figure 2:
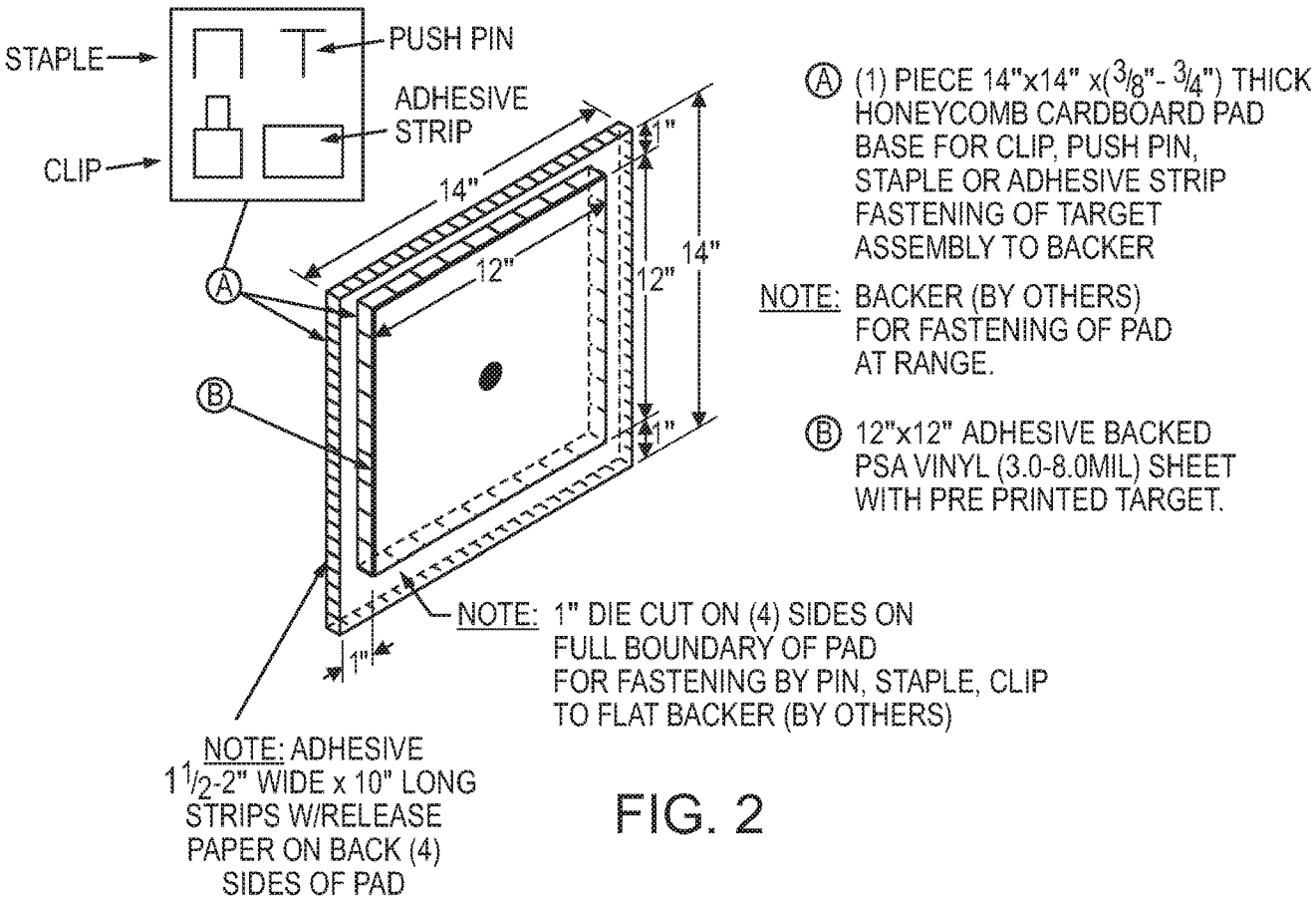
FIG. 2 shows a side elevation isometric component of an embodiment of the assembled honeycomb target pad invention.

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

Figure 1:
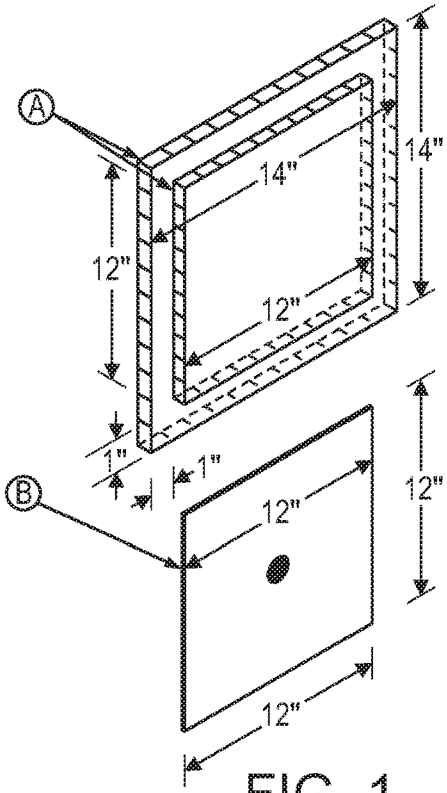
FIG. 1 shows a front elevation isometric un-assembled view of an embodiment of the honeycomb target pad invention.

FIG. 1 shows a front elevation isometric assembled view of an embodiment of the honeycomb target pad invention. Preferably, the honeycomb target pad is configured with a ⅜" to ¾" thick 14"×14" honeycomb cellulosic kraft paper pad for direct fastening to a target backer. In some embodiments, the 14"×14" honeycomb cellulosic kraft paper pad is made with cross-linked space technology, with the advantages of being water-proof, durable to projectile impact, and recyclable. In this configuration, it can be nontoxic and environmentally friendly. Only trace, potentially, negliable remains of projectiles that impact the honeycomb could be considered nonrecyclable.

FIG. 2 shows a side elevation isometric component of an embodiment of the honeycomb target pad invention. Referring to FIGS. 1 and 2, the 1" die cut border of all (4) sides of the pad face may be provided for ease of fastening to multiple backer surfaces with either staple, pin or clip attachments.

Figure 3:
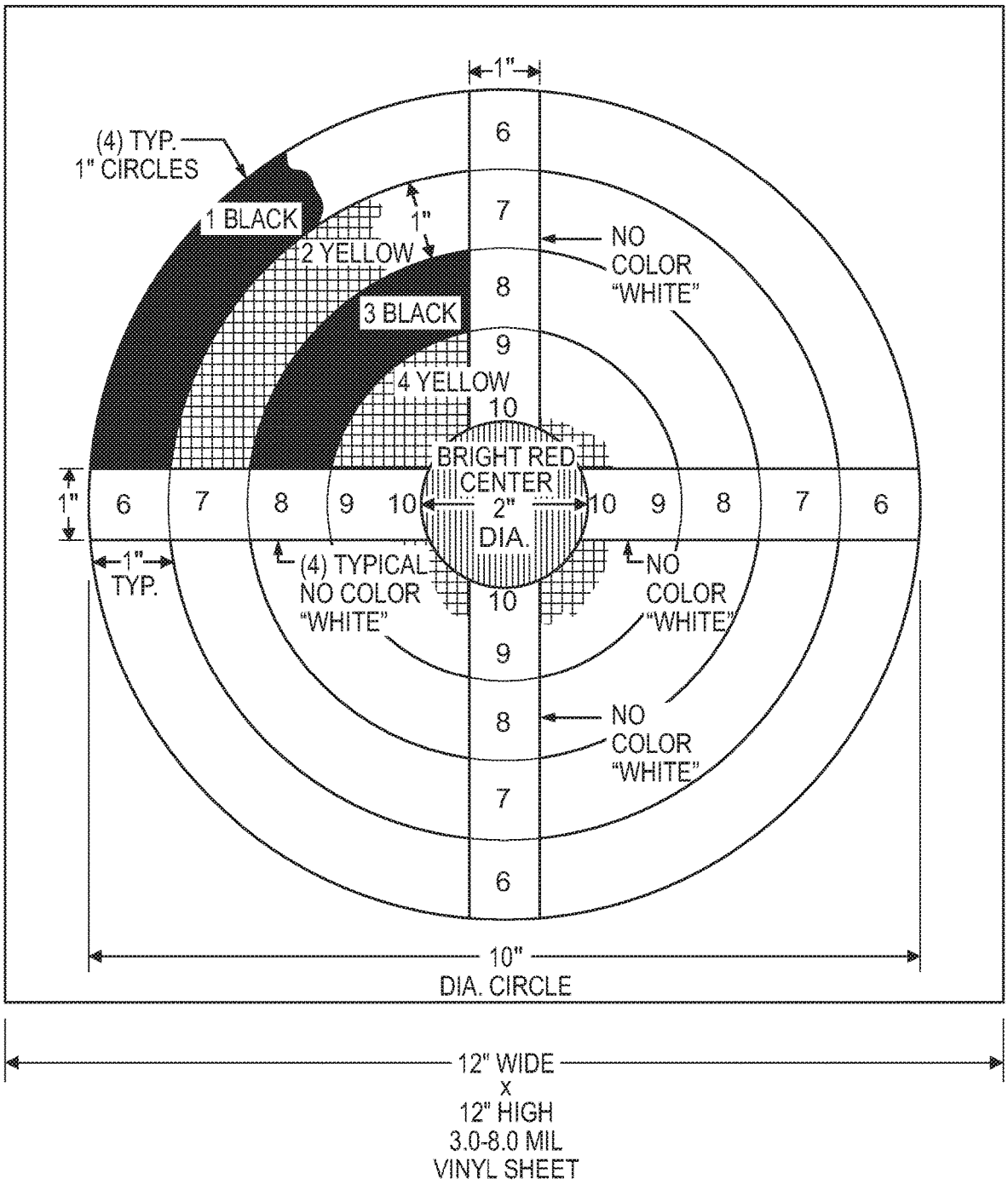
FIG. 3 shows an example of the bullseye design of the honeycomb target pad invention according to an embodiment of the invention.

FIG. 3 shows an example of the bullseye target configuration of the honeycomb target pad according to an embodiment of the invention. Referring to FIGS. 1, 2, 3, preferably the honeycomb target pad is preprinted with a 3.0-8.0 mil vinyl 12"×12" sheet with pressure sensitive adhesive (PSA) backed target sheet for peel and stick application to the honeycomb target pad.

Figure 4:
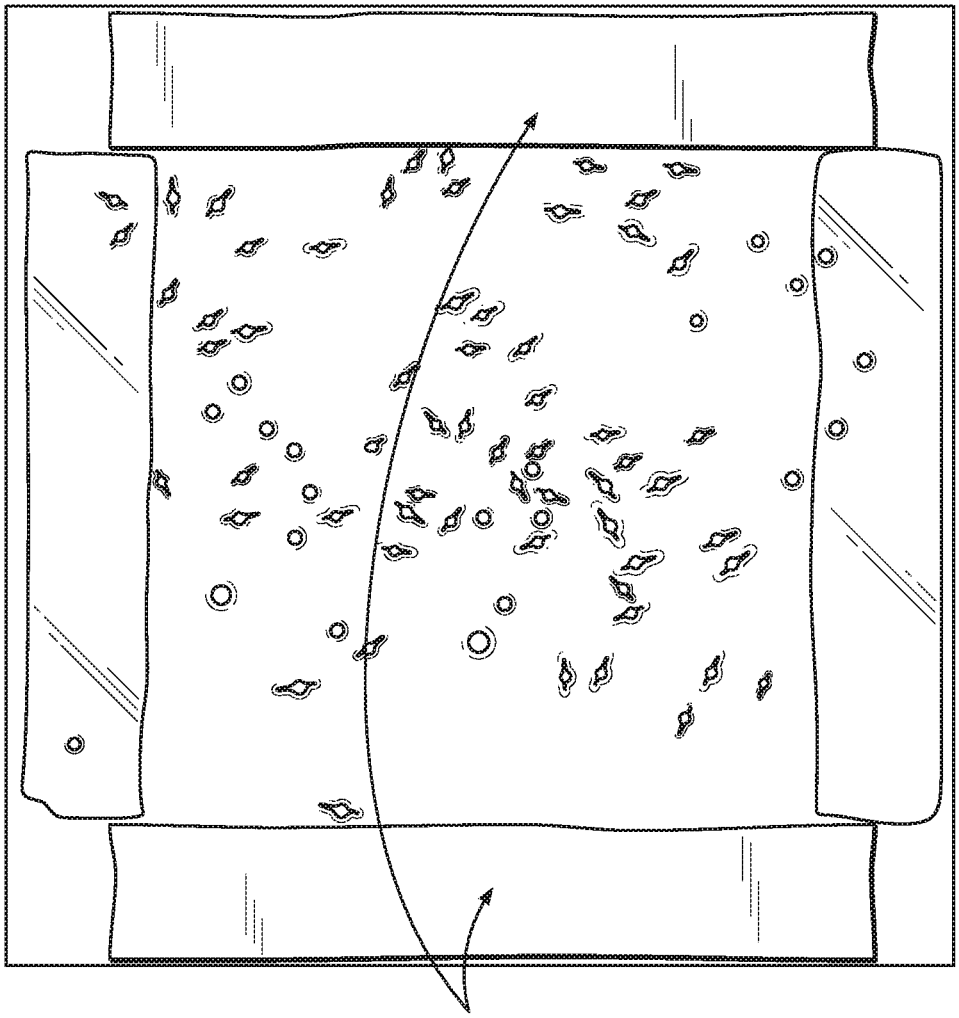
FIG. 4 shows an example of adhesive back side with (2) strips exposed ready for attachment of the honeycomb target pad according to an embodiment of the invention.
Figure 5:
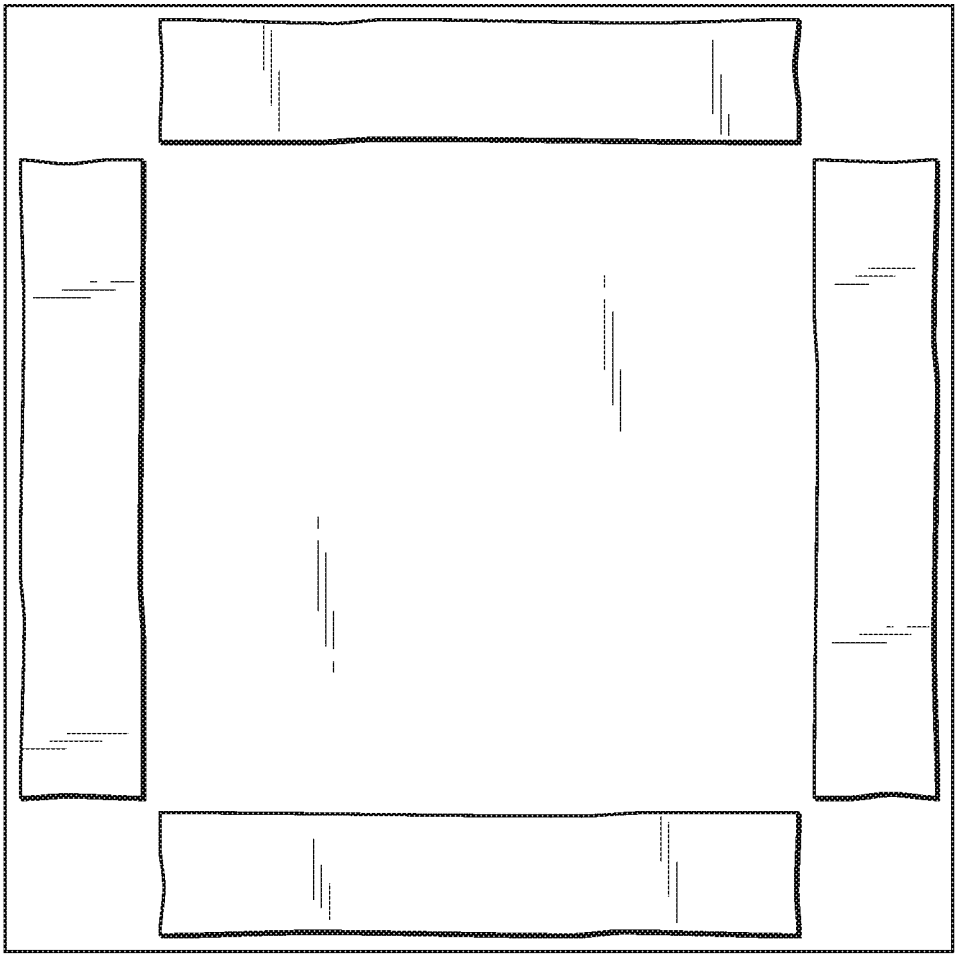
FIG. 5 shows virgin back of the honeycomb target pad with four 10" adhesive strips according to an embodiment of the invention.

Referring to FIGS. 1, 2 preferably the honeycomb target pad is configured with a PSA backed reusable honeycomb 14"×14" pad for multiple uses as a reusable range and field target. For example, FIG. 4 shows an adhesive back side of the honeycomb target pad with (2) strips exposed ready for attachment according to an embodiment of the invention. FIG. 5 shows virgin back with four 10" adhesive strips according to an embodiment of the invention.

Figure 6:
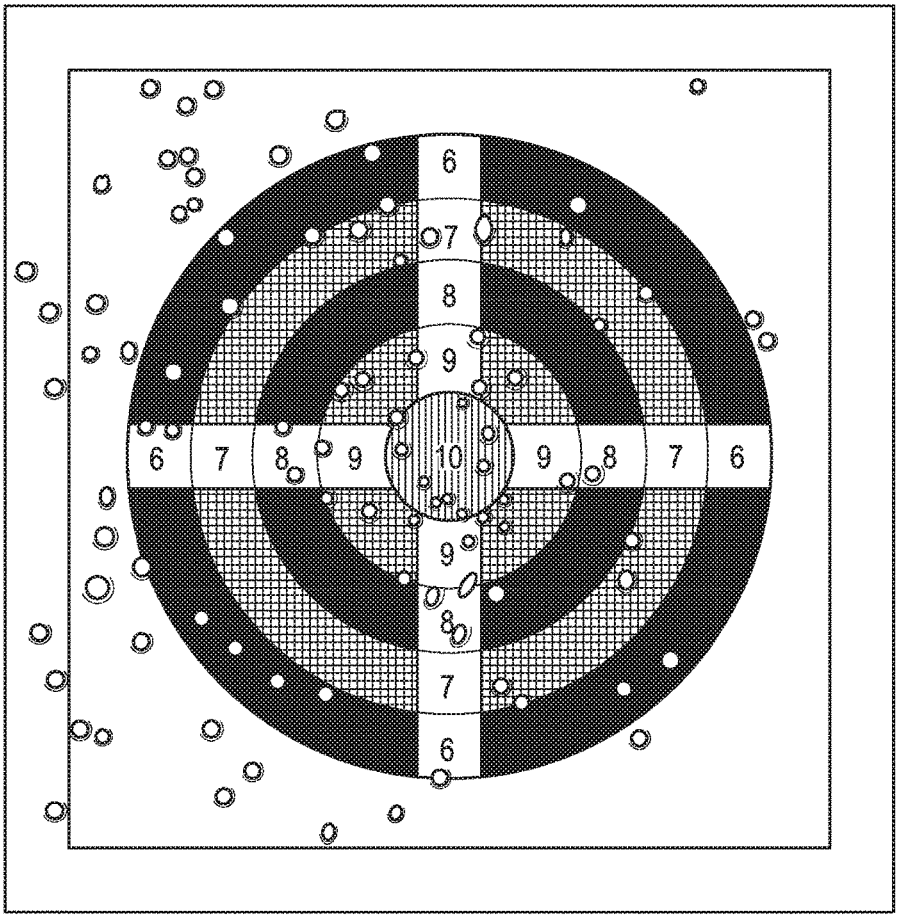
FIG. 6 shows 107 rounds of impact of the honeycomb target pad from 12 gauge 00 buck, 5.56 mm rifle, range test at 25 yards according to an embodiment of the invention.
Figure 7:
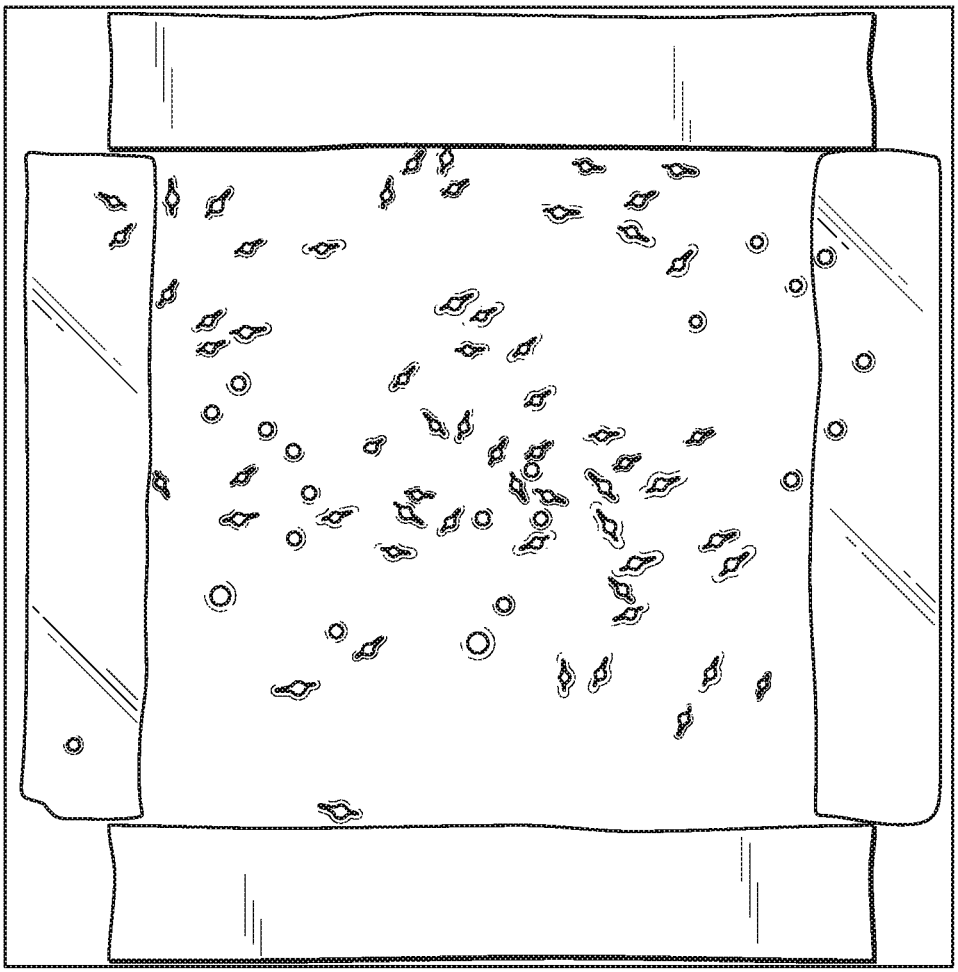
FIG. 7 shows adhesive strips of the honeycomb target pad exposed after 25 yard range test according to an embodiment of the invention.

The honeycomb target pad provides a robust construction, uniquely resistant to projectile impact. In terms of projectile impact, FIGS. 6 and 7 evidence the durability of the honeycomb target pad. In FIG. 6, projectile impact included 107 rounds of ammunition from 12 gauge 00 buck, 5.56 mm rifle, range test at 25 yards. FIG. 7 shows adhesive strips exposed after 25 yard range test according to an embodiment of the invention.

Figure 8:
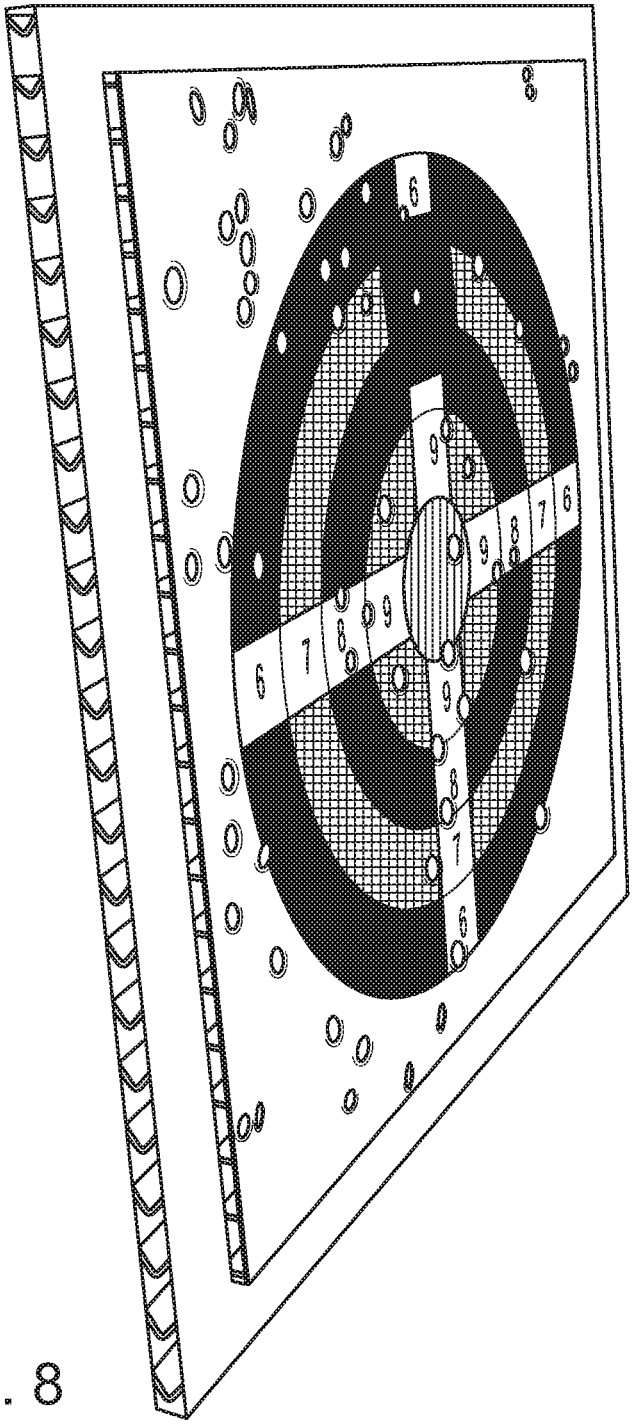
FIG. 8 is a side view of a die cut 1" perimeter of the honeycomb target pad for ease of fastening with staples, pins, or spring clips according to an embodiment of the invention.

The honeycomb target pad is uniquely configured to be easily attached to structures and objects. FIG. 8 is a side view of the die cut 1" perimeter border of the honeycomb pad that shows it can be easily fastened with staples, pins, or spring clips according to an embodiment of the invention. The perimeter of the honeycomb cardboard pad media, can be die cut for ease of field installation for fastening range target to backers.

Reusable adhesive can be included on the backside of the honeycomb pad for fastening the target to wide variety of flat backer surfaces. Preferably, a vinyl preprinted adhesive backed bullseye peel and stick target is provided for multiple range visits, by layering over the spent existing vinyl printed surface, for example 2-5 layers, or more. In some embodiments, the raised epicenter formed by the die cutting, is the 12"×12" honeycomb target pad base for centering of vinyl printed bullseye target. Example further features and advantages of embodiments are discussed below:

(1) 14"×14" (⅜-¾") thick honeycomb kraft paper pad can have a 1" die cut crushed perimeter for ease of target installation. The elevated 12"×12" target base can allow for ease of replacement target installation, and permanent stick adhesive can be applied to the back panel for peel & stick installation on flat backer surfaces. Reusable PSA with release paper can allow for multiple applications.

(1) 12"×12" (3.0-8.0 mil) preprinted PSA target can be affixed to the 12"×12" elevated honeycomb pad, centered on the 14"×14" o.d. Honeycomb kraft paper pad.

The die cut honeycomb pad when combined with a PSA vinyl sheet target and PSA back can be used as a reusable range and field target.

1½ to 2" reusable adhesive strips can provide honeycomb pad adhesion to all varieties of backer surfaces.

The target has been successfully field tested with a single range session with 200 rounds of combined 7.62 caliber rifle and 12 gauge 00 buck shot ammunition at 25 yards.

The honeycomb pad can have a supported vertical compression weight loading of 330 psig testing with no loss of integrity.

Multiple peel and stick adhesive tests and field use on plywood, sheet metal and plastic backer surfaces have been successful.

Upon loss of adhesive, a user can utilize push pins, staples or spring loaded clips as fastening alternatives on flat backer surfaces.

Water spray testing of the pad, vinyl target sheet and permanent stick adhesive was performed with no loss of target integrity.

Extreme cold exposure test of −5.0 F in a freezer for adhesion and durability test was successful.

Extreme heat exposure test of 150.0 F in an oven for adhesion and durability test was successful.

Figure 9:
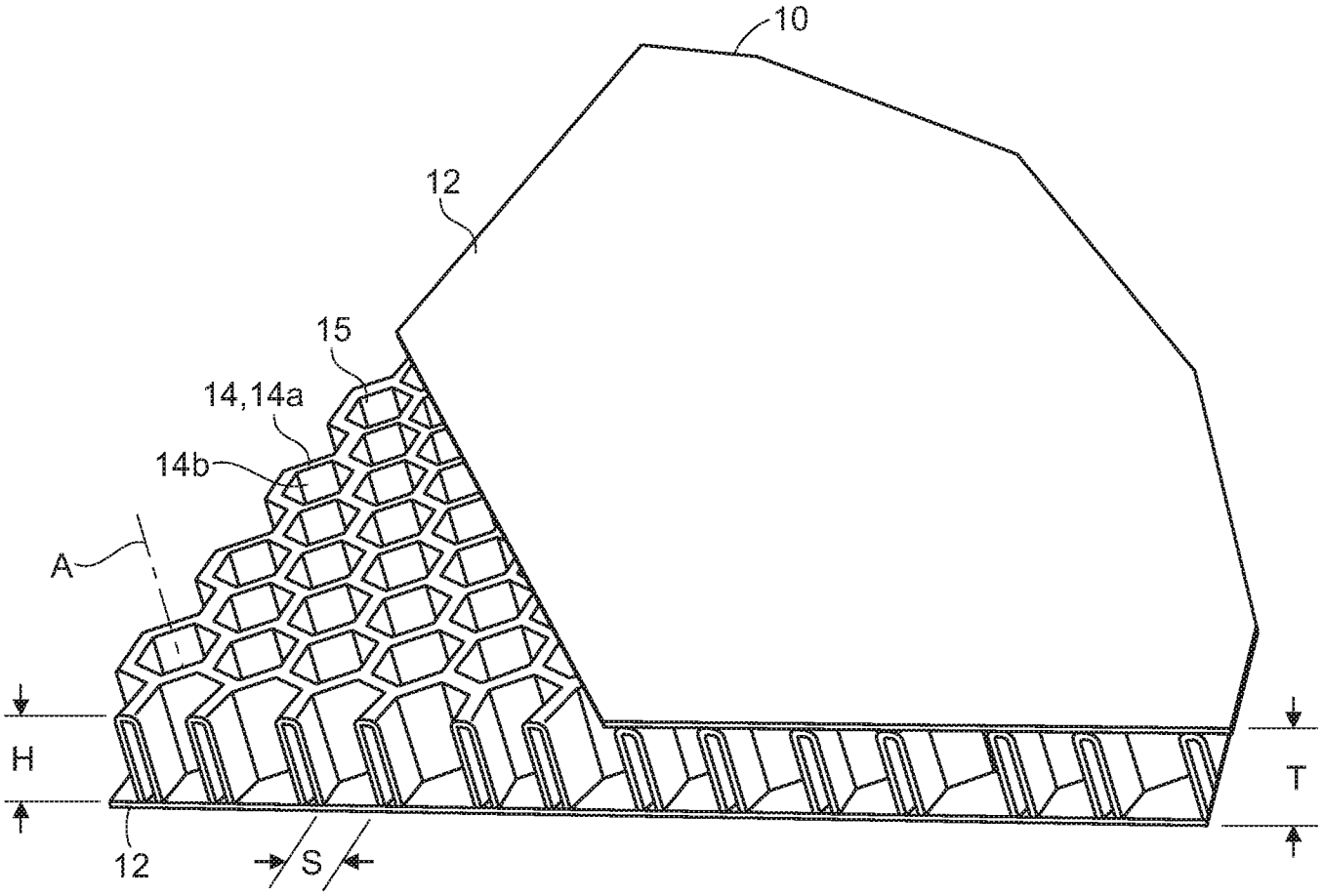
FIG. 9 is a perspective view of a portion of honeycomb material with part of the sheet material removed.

Referring to FIG. 9, in some embodiments, the honeycomb target pad can be formed of cellulosic honeycomb 10 having a thickness T ranging from about ⅜ to 1 inch, and often about ⅜ to ¾ inch. The cellulosic honeycomb 10 can have a honeycomb cell structure 15 formed of thin sheet material, with flat sheet material 12 bonded to and covering opposite parallel sides thereof. The honeycomb cell structure 15 can include a series of adjoining cells 14 having cell walls 14*a* surrounding cell cavities 14*b*, which are covered or enclosed by the flat sheet material 12. The cell walls 14*a* can have a height H extending generally perpendicular relative to the flat sheet material 12. As a result, the thin sheet thickness dimension of the cell walls 14*a* extends in a direction parallel to the path of projectiles, generally shown by axis or axes A. The cell cavities 14*b* can have a size or width S ranging from about ⅜ to 1 inch across, (2.7 to 1 cells per inch) and often about ⅜ to ¾ inches (2.7 to 1.3 cells per inch). Such cell cavities 14*b* can provide open longitudinal axial pathways, tubes, channels or tunnels between or surrounded by the cell walls 14*a*, that are axially aligned with axes A, so that projectiles ranging in size from birdshot, .17 or .22 caliber through shotgun slugs, travelling along an axis or axes A can pass through the honeycomb cell structure 15 with minimal damage to the cell walls 14*a* by mostly passing through the cell cavities 14*b*. Smaller cell cavities 14*b* can be used for smaller caliber projectiles, and larger cell cavities 14*b* can be used for large caliber projectiles.

In one embodiment, the cellulosic honeycomb 10 can be about ½ inch thick in the central portion, and can be crushed or compressed by die cutting in the outer perimeter border flange portion to be stepped down to about 5/16 to ⅜ inches thick. The outer perimeter border flange portion by being crushed, can be somewhat flexible relative to the uncrushed raised central portion which can remain generally smooth, rigid and flat. This can aid in fastening to a support structure or surface that is uneven. The raised central portion can be about 12×12 inches wide, and the whole pad including the outer perimeter border flange portion can be about 14×14 inches wide. The honeycomb cells 14 can be generally polygonal, such as generally quadrilateral or hexagonal, and can have a size between flats of about ½ inch (2 cells per inch). The flat sheet material 12 and the sheet material forming the cell walls 14*a* can be about 0.012-0.015 inches thick. The central portion of the pad can have a lateral pad size to pad thickness ratio of about 12:1 through 32:1, and can be about 24:1. In some embodiments, instead of forming the outer perimeter border flange portion by die cutting one piece of honeycomb, the target pad can be formed by adhering and layering two pieces of honeycomb pads of different sizes together.

Due to the generally large height H of the honeycomb cell structure 15 perpendicular to the flat sheet material 12, and that projectiles can pass through the honeycomb cell structure 15 by passing through the cell cavities 14*b* along axes A parallel to the cell walls 14*a* so that there is minimal damage to the cell walls 14*a*, the honeycomb cell structure 15 can maintain structural integrity, rigidity and flatness despite large numbers of rounds passing therethrough. Even with some damage to the honeycomb cell structure 15, the large perpendicular height H can still provide sufficient structural strength to maintain rigidity and flatness of the central portion or region of the target pad. As a result, additional adhesive back target images can be placed over the central portion after use which structurally reinforces the honeycomb cell structure 15 for further use.

While example embodiments have been particularly shown and described, it will be understood by those skilled in the art that various changes in form and details may be made therein without departing from the scope of the embodiments encompassed by the appended claims.

In some embodiments, different widths, sizes, shapes and thicknesses of the pads can be used, for example larger or smaller sizes, or round shapes. The outer perimeter border flange portion can extend only partially around the target pad, for example two sides. In addition, the honeycomb pads can be made of plastics, for example polypropylene. In some embodiments in the present invention, honeycomb targets can be custom manufactured in various sizes and shapes to match a shooter's specific requirements. For example, a large honeycomb target can be provided for 1000 yard long precision center fire rifle shooters, and a small honeycomb target can be provided for short range pellet gun and/or .22 caliber rim fire shooters.

What is claimed is:

1. A target device comprising:

a target pad formed of honeycomb cellulosic material having a central portion and a perimeter portion, the central portion having a thickness ranging from about ⅜ to 1 inch that is greater than a thickness of the perimeter portion, whereby the perimeter portion forms an outer perimeter border flange of the target device with reduced thickness allowing easy securement to a mounting structure with fasteners, the target pad comprising a honeycomb cell structure having cells with cell walls surrounding cell cavities, the honeycomb cell structure being covered on each side with parallel flat sheet material, the cell walls being formed of shaped cellulosic sheet material extending generally perpendicular to the flat sheet material and in a direction parallel to projectile path, the cell cavities having a size ranging from about ⅜ to 1 inch across to allow the passage of projectiles therethrough with minimal damage to the cell walls; and a first target image extending over the central portion of the target pad.

2. The target device of claim 1 in which the honeycomb cells are generally hexagonal.

3. The target device of claim 1 in which the perimeter portion is in a compressed state with collapsed cell walls to form the outer perimeter border flange with reduced thickness.

4. The target device of claim 1 in which the perimeter portion is a stepped down outer perimeter border flange that allows easy fastening to the mounting structure with staples, pins or spring clips.

5. The target device of claim 1 further comprising an adhesive backed second target image for applying to the central region over the first target image after initial target use, thereby structurally reinforcing the honeycomb cell structure and providing a new second target image for use.

6. The target device of claim 1 further comprising:

multiple 1" to 2" PSA strips on back of the target pad for peel & stick application to a surface, such that the PSA strips allow for multiple reuse of target.

7. The target device of claim 6 wherein the target pad has a thickness of (⅜-¾") and is a 14"×14" precut pad with perimeter die cut recessed precut pad, such that the die cut recessed perimeter provides ease of fastening to a backer with three separate types of fasteners.

8. The target device of claim 6 having a 12"×12" (3.0-8.0 mil) preprinted vinyl PSA sheet for adhesion to a 12"×12" raised face area of pad.

9. The target device of claim 6 having vinyl 12"×12" preprinted target sheets that can be layered for repeated use of the target pad.

10. The target device of claim 6 wherein the target pad is radically different due to exceptional structural strength, water resistance and fastening versatility.

11. The target device of claim 6 further including the ability for reuse on multiple range shooting sessions without additional cost incurred to the shooter.

* * * * *